US008542180B2

(12) United States Patent
Park et al.

(10) Patent No.: US 8,542,180 B2
(45) Date of Patent: Sep. 24, 2013

(54) METHOD OF DRIVING DISPLAY PANEL AND DISPLAY APPARATUS FOR PERFORMING THE SAME

(75) Inventors: Hye-Kwang Park, Cheonan-si (KR); Sang-Heon Park, Asan-si (KR); Seung-Hwan Moon, Asan-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 212 days.

(21) Appl. No.: 13/217,037

(22) Filed: Aug. 24, 2011

(65) Prior Publication Data

US 2012/0139436 A1 Jun. 7, 2012

(30) Foreign Application Priority Data

Dec. 6, 2010 (KR) ..... 2010-0123265

(51) Int. Cl.
*G09G 3/36* (2006.01)

(52) U.S. Cl.
USPC ..... 345/100; 345/98

(58) Field of Classification Search
USPC ..... 345/98, 100
See application file for complete search history.

(56) References Cited

U.S. PATENT DOCUMENTS

| | | | | |
|---|---|---|---|---|
| 7,109,965 | B1 | 9/2006 | Lee et al. | |
| 7,333,586 | B2 * | 2/2008 | Jang | 377/64 |
| 7,944,427 | B2 * | 5/2011 | Choi | 345/100 |
| 8,169,395 | B2 * | 5/2012 | Jo et al. | 345/99 |
| 2009/0309824 | A1 * | 12/2009 | Kwon et al. | 345/98 |

FOREIGN PATENT DOCUMENTS

| | | |
|---|---|---|
| KR | 10200400003246 | 1/2004 |
| KR | 1020070062823 | 6/2007 |
| KR | 1020070084943 | 8/2007 |

* cited by examiner

*Primary Examiner* — Kevin M Nguyen
(74) *Attorney, Agent, or Firm* — F. Chau & Associates, LLC

(57) ABSTRACT

A method of driving a display panel includes generating a gate on voltage, a first gate off voltage and a second gate off voltage. A clock signal is generated based upon the gate on voltage and the second gate off voltage. A first panel gate off voltage substantially the same as the first gate off voltage and a second panel gate off voltage substantially the same as the second gate off voltage are generated in a first operating mode. A first panel gate off voltage greater than the first gate off voltage and a second panel gate off voltage greater than the second gate off voltage are generated in a second operating mode. A gate signal is generated based upon the clock signal and the first and second panel gate off voltages to a gate line of the display panel.

21 Claims, 5 Drawing Sheets

METHOD OF DRIVING DISPLAY PANEL AND DISPLAY APPARATUS FOR PERFORMING THE SAME

CROSS-REFERENCE TO RELATED APPLICATION

This application claims priority under 35 U.S.C. §119 to Korean Patent Application No. 2010-123265, filed on Dec. 6, 2010 in the Korean Intellectual Property Office (KIPO), the entire content of which is incorporated by reference herein.

BACKGROUND

1. Technical Field

The present disclosure relates to a method of driving a display panel and a display apparatus for performing the method, and, more particularly, to a method of driving a display panel capable of discharging a voltage charged in the display panel and a display apparatus for performing the method.

2. Discussion of the Related Art

Typically, a liquid crystal display (LCD) apparatus includes a first substrate including a pixel electrode, a second substrate including a common electrode and a liquid crystal layer disposed between the first and second substrates. An electric field is generated by voltages applied to the pixel electrode and the common electrode. By adjusting the intensity of the electric field, the transmittance of light passing through the liquid crystal layer is, in turn, adjusted so that a desired image can be displayed.

The first substrate includes a thin film transistor (TFT) connected to the pixel electrode. The TFT transmits a grayscale data voltage to the pixel electrode in response to a gate signal when the LCD apparatus is turned on.

When the LCD apparatus is turned off, it is desirable that an image displayed on the LCD panel quickly disappears. However, when the LCD apparatus is turned off, the gray data voltage of the pixel electrode is slowly discharged to a ground voltage. Thus, even though the LCD apparatus is turned off, the image on the LCD panel does not disappear quickly.

SUMMARY

Exemplary embodiments of the present invention provide a method of driving a display panel capable of quickly discharging a grayscale data voltage of a pixel electrode so that an image on the display panel quickly disappears when a display apparatus is turned off.

Exemplary embodiments of the present invention also provide a display apparatus for performing the above-mentioned method.

In accordance with an exemplary embodiment a method of driving a display panel includes generating a gate on voltage, a first gate off voltage and a second gate off voltage. A clock signal is generated based upon the gate on voltage and the second gate off voltage. In a first operating mode a first panel gate off voltage substantially the same as the first gate off voltage and a second panel gate off voltage substantially the same as the second gate off voltage are generated. In a second operating mode a first panel gate off voltage greater than the first gate off voltage and a second panel gate off voltage greater than the second gate off voltage are generated. A gate signal generated based upon the clock signal and the first and second panel gate off voltages is outputted to a gate line of the display panel.

The first panel gate off voltage may be generated based upon the gate on voltage in the second operating mode.

Generating the second panel gate off voltage may include boosting the second panel gate off voltage based upon the first panel gate off voltage in the second operating mode.

Generating the second panel gate off voltage may further include disconnecting a first input terminal to which the first gate off voltage is applied from a first output terminal outputting the first panel gate off voltage in the second operating mode.

The method may further include pulling up the clock signal in the second operating mode.

According to an exemplary embodiment a display apparatus is provided and includes display panel that displays an image, a voltage generator that generates a gate on voltage, a first gate off voltage and a second gate off voltage, a signal generator that generates a clock signal based upon the gate on voltage and the second gate off voltage, a discharging part that generates a first panel gate off voltage substantially the same as the first gate off voltage and a second panel gate off voltage substantially the same as the second gate off voltage in a first operating mode, and that generates a first panel gate off voltage greater than the first gate off voltage and a second panel gate off voltage greater than the second gate off voltage in a second operating mode; and a gate driver that generates a gate signal based upon the clock signal and the first and second panel gate off voltages, and that outputs the gate signal to a gate line of the display panel.

The first operating mode may be performed when the display apparatus is turned on, and the second operating mode may be performed when the display apparatus is turned off.

The discharging part may include a first input terminal to which the first gate off voltage is applied, a second input terminal to which the second gate off voltage is applied, a first output terminal that outputs the first panel gate off voltage, and a second output terminal that outputs the second panel gate off voltage.

The discharging part may generate the first panel gate off voltage based upon the gate on voltage in the second operating mode.

The discharging part may include a first capacitor in which the gate on voltage is charged in the first operating mode, and a first switching element that transmits the gate on voltage charged in the first capacitor to the first output terminal in the second operating mode.

The discharging part may further include a second capacitor connected between the first and second output terminals to boost the second panel gate off voltage.

The discharging part may further include a second switching element that disconnects the first input terminal from the first output terminal in the second operating mode.

The second switching element may include a NPN type bipolar junction transistor.

The display apparatus may further include a pull-up part connected to an output terminal of the signal generator, and that pulls up the clock signal in the second operating mode.

The pull-up part may include a pull-up resistor, the gate on voltage being applied to a first end of the pull-up resistor, and a second end of the pull-up resistor may be connected to the output terminal of the signal generator.

The voltage generator may include a first gate off voltage generating part that generates the first gate off voltage using an input voltage, and a second gate off voltage generating part connected to the first gate off voltage generating part, the second gate off voltage generating part generating the second gate off voltage, and the first and second gate off voltage generating parts may respectively include a diode and a capacitor.

The gate on voltage may has a positive value and the first and second gate off voltages may have negative values, the second gate off voltage being more negative than the first gate off voltage.

The gate driver may be integrated on the display panel to have an amorphous silicon gate type.

According to an exemplary embodiment, a method for driving a display panel, includes driving a gate line of a display panel during a turn-on period based upon a gate on voltage having a voltage value for turning on a switching element coupled to the gate line of the display panel, discharging the gate line based upon a first gate off voltage and a second gate off voltage for discharging the gate line of the display panel, first gate off voltage and the second gate off voltage having voltage values for turning off the switching element, using the second gate off voltage during a first time period from a turn-off moment of the switching element and using the first gate off voltage after the first time period from the turn-off moment of the switching element to maintain the switching element turned off. The gate on voltage has a positive value and the first gate off voltage and the second gate off voltage have negative values, the second gate off voltage being more negative than the first gate off voltage.

BRIEF DESCRIPTION OF THE DRAWINGS

The above and other features and advantages of the present invention will become more apparent by describing in detailed exemplary embodiments thereof with reference to the accompanying drawings, in which.

DETAILED DESCRIPTION

Figure 1:
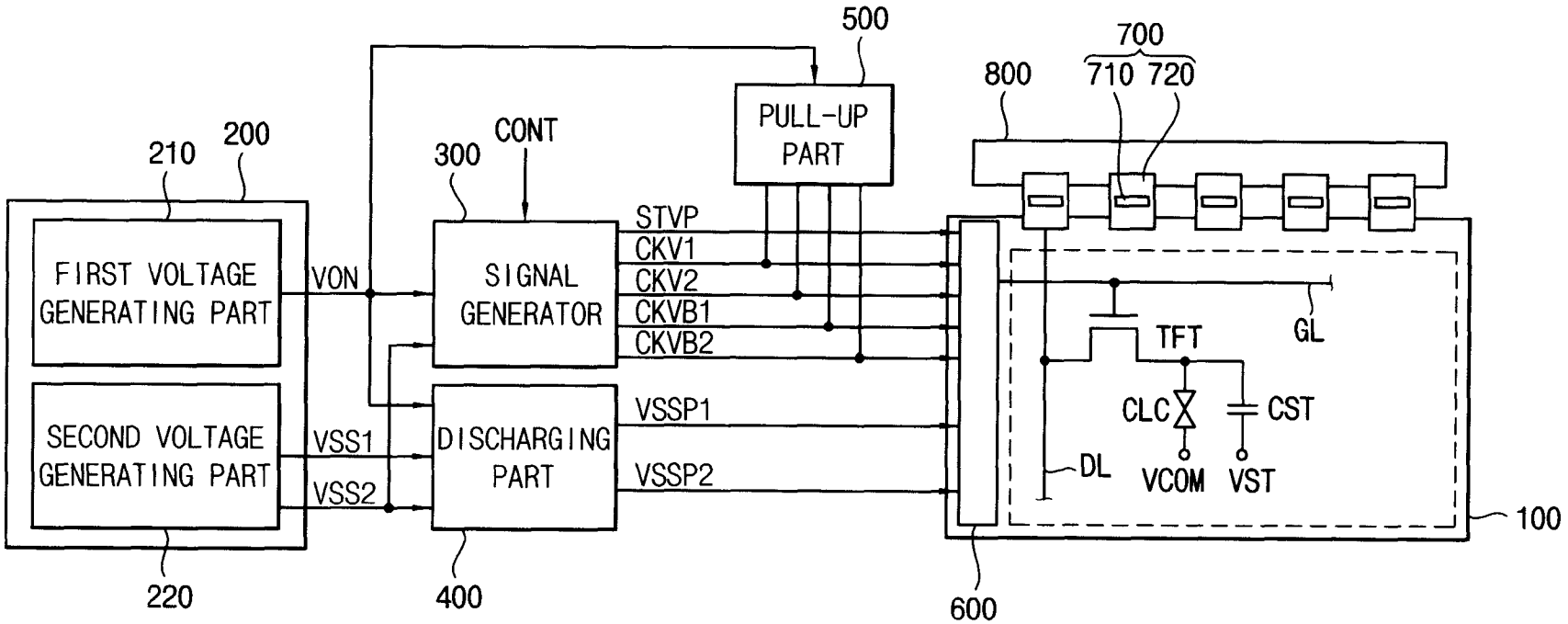
FIG. 1 is a block diagram illustrating a display apparatus according to an exemplary embodiment of the present invention.

FIG. 1 is a block diagram illustrating a display apparatus according to an exemplary embodiment of the present invention.

Referring to FIG. 1, the display apparatus includes a display panel 100, a voltage generator 200, a signal generator 300, a discharging part 400, a pull-up part 500 and a gate driver 600, a data driver 700 and a printed circuit board 800.

The display panel 100 includes a gate line GL, a data line DL, a switching element TFT, a liquid crystal capacitor CLC and a storage capacitor CST.

The gate line GL extends in a first direction, and the data line DL extends in a second direction crossing the first direction. The gate line GL may extend in a direction parallel to a longer side of the display panel 100, and the data line DL may extend in a direction parallel to a shorter side of the display panel 100.

The switching element TFT is connected to the gate line GL and the data line DL. The switching element TFT may be a thin film transistor.

The liquid crystal capacitor CLC and the storage capacitor CST are electrically connected to the switching element TFT to charge a grayscale data voltage. The liquid crystal capacitor CLC and the storage capacitor CST act as a load on the switching element TFT. The liquid crystal capacitor CLC may be configured as a pixel electrode of a first substrate and a common electrode of a second substrate facing the first substrate. The storage capacitor CST may be configured as the pixel electrode and a storage electrode. The gray scale data voltage is applied to the pixel electrode, and a common voltage is applied to the common electrode VCOM. A storage voltage VST is applied to the storage electrode. The storage voltage VST may be substantially the same as the common voltage VCOM.

The voltage generator 200 includes a first voltage generating part 210 and a second voltage generating part 220. The first voltage generating part 210 generates a gate on voltage VON. The second voltage generating part 220 generates a first gate off voltage VSS1 and a second gate off voltage VSS2. The first voltage generating part 210 outputs the gate on voltage VON to the signal generator 300. The first voltage generating part 210 may also output the gate on voltage VON to the discharging part 400 and the pull-up part 500. The second voltage generating part 220 outputs the first and second gate off voltages VSS1, VSS2 to the discharging part 400. The second voltage generating part 220 also outputs the second gate off voltage VSS2 to the signal generator 300.

The gate on voltage VON has a value (noted below) for turning on the switching element TFT of the display panel 100. The first and second gate off voltages VSS1, VSS2 have values (noted below) for turning off the switching element TFT of the display panel 100. The second gate off voltage VSS2 is used during a first time period from a turn-off moment of the switching element TFT. The first gate off voltage VSS1 is used after the first time period from the turn-off moment of the switching element TFT to maintain the switching element TFT turned off. The first time period may be very short relative to the response delay of the switching element TFT which is compensated using the second gate off voltage VSS2 so that the switching element TFT may be turned off when the LCD apparatus is turned off.

For example, the gate on voltage VON may have a positive (+) value. The first and second gate off voltages VSS1, VSS2 may have negative (−) values. The second gate off voltage VSS2 may be more negative than the first gate off voltage VSS1.

For example, the gate on voltage VON may be between about 15V and about 30V. The first gate off voltage VSS1 may be between about −5.5V and −6.0V. The second gate off voltage VSS2 may be between about −9.5V and −10.0V. A difference between the first and second gate off voltages VSS1, VSS2 may be between about −3.5V to −4.0V. Such negative voltage differential can help compensate the response delay of the switching element TFT by providing the more negative second gate off voltage VSS2 voltage so that the switching element TFT may be turned off at the desired moment.

In an exemplary embodiment, when driving the display panel 100, the difference between the first and second gate off voltages VSS1, VSS2 may be uniformly maintained.

The second voltage generating part 220 may include a charge pump circuit generating a direct current (DC) voltage in response to a pulse width modulation (PWM) signal. The second voltage generating part 220 is explained in more detail later below, referring to FIG. 2.

The signal generator 300 receives the gate on voltage VON from the first voltage generating part 210 and the second gate off voltage VSS2 from the second voltage generating part 220. The signal generator 300 receives a control signal CONT from a timing controller (not shown). The signal generator 300 generates a vertical start signal STVP and clock signals based upon the gate on voltage VON, the second gate off voltage VSS2 and the control signal CONT.

The clock signal may include a first clock signal CKV1, a second clock signal CKV2, a first inverted clock signal CKVB1 and a second inverted clock signal CKVB2. The second clock signal CKV2 may be delayed in a half of a horizontal cycle with respect to the first clock signal CKV1. The first inverted clock signal CKVB1 may be inverted with respect to the first clock signal CKV1. The second inverted clock signal CKVB2 may be inverted with respect to the second clock signal CKV2.

For example, the first clock signal CKV1 and the first inverted clock signal CKVB1 may be used to generate gate signals applied to odd-numbered gate lines of the display panel 100. The second clock signal CKV2 and the second inverted clock signal CKVB2 may be used to generate gate signals applied to even-numbered gate lines of the display panel 100. The first clock signal CKV1 may be used to generate gate signals applied to (4N−3)-th gate lines. Herein, N is a natural number. The first inverted clock signal CKVB1 may be used to generate gate signals applied to (4N−1)-th gate lines. The second clock signal CKV2 may be used to generate gate signals applied to (4N−2)-th gate lines. The second inverted clock signal CKVB2 may be used to generate gate signals applied to (4N)-th gate lines.

The clock signal may include only the first clock signal CKV1 and the first inverted clock signal CKVB1. In this case, the first clock signal CKV1 may be used to generate the gate signals applied to the odd-numbered gate lines of the display panel 100, and the first inverted clock signal CKVB1 may be used to generate the gate signals applied to the even-numbered gate lines of the display panel 100.

A single gate driver may be employed to apply gate signals to both odd-numbered gate lines and even-numbered gate lines. Alternatively, a first gate driver may be employed to apply the gate signals to the odd-numbered gate lines and a second gate driver may be employed to apply the gate signals to the even-numbered gate lines. Such first gate driver and second gate driver may be located at opposing sides of the display panel.

The discharging part 400 receives the first and second gate off voltages VSS1, VSS2 from the second voltage generating part 220. The discharging part 400 may receive the gate on voltage VON from the first voltage generating part 210.

The discharging part 400 generates a first panel gate off voltage VSSP1 and a second panel gate off voltage VSSP2 based upon the gate on voltage VON and the first and second gate off voltages VSS1, VSS2. The discharging part 400 outputs the first and second panel gate off voltages VSSP1, VSSP2 to the gate driver 600.

When the display apparatus is turned on, the discharging part 400 generates the first panel gate off voltage VSSP1 substantially the same as the first gate off voltage VSS1 and the second panel gate off voltage VSSP2 substantially the same as the second gate off voltage VSS2.

For example, when the display apparatus is turned on, the discharging part 400 does not substantially influence the other elements, and merely transmits the first and second gate off voltages VSS1, VSS2 to the gate driver 600.

When the display apparatus is turned off, the discharging part 400 generates the first panel gate off voltage VSSP1 greater than the first gate off voltage VSS1 and the second panel gate off voltage VSSP2 greater than the second gate off voltage VSS2.

The discharging part 400 may boost the first panel gate off voltage VSSP1 to a level of the gate on voltage VON, and may boost the second panel gate off voltage VSSP2 to approach the level of the first panel gate off voltage VSSP1. Such boosting allows the switching element TFT to be easily turned on such that the grayscale data voltage charged to the pixel electrode of the display panel 100 may be quickly discharged through the data line DL. Thus, when the display apparatus is turned off, an image on the display panel may quickly disappear. The discharging part 400 is explained in more detail later below, referring to FIG. 3.

The pull-up part 500 is connected to output terminals of the signal generator 300, which output the clock signals CKV1, CKV2, CKVB1, CKVB2. When the display apparatus is turned on, the pull-up part 500 does not substantially influence the other elements. When the display apparatus is turned off, the pull-up part 500 pulls up the clock signals CKV1, CKV2, CKVB1, CKVB2. The pull-up part 500 may receive the gate on voltage VON from the first voltage generating part 210. The pull-up part 500 may pull up the clock signals CKV1, CKV2, CKVB1, CKVB2 based upon the gate on voltage VON. The pull-up part 500 is explained in more detail later below, referring to FIG. 4.

The gate driver 600 receives the vertical start signal STVP and the clock signals CKV1, CKV2, CKVB1, CKVB2 from the signal generator 300. The gate driver 600 receives the first and second panel gate off voltages VSSP1, VSSP2 from the discharging part 400.

The gate driver 600 generates gate signals based upon the clock signals CKV1, CKV2, CKVB1, CKVB2 and the first and second panel gate off voltages VSSP1, VSSP2, and outputs the gate signals to the gate lines GL of the display panel 100.

The gate signal may be a pulse signal, such as one based upon PWM. A high level of the gate signals is generated using the clock signals CKV1, CKV2, CKVB1, CKVB2, and may be substantially the same as the gate on voltage VON. A low level of the gate signals is generated using the clock signals CKV1, CKV2, CKVB1, CKVB2 and the first gate off voltage VSS1. The low level of the gate signals may be substantially the same as the second panel gate off voltage VSSP2 at a falling edge of the gate signal, and may be substantially the same as the first panel gate off voltage VSSP1 subsequent to the falling edge.

The gate driver 600 may include a plurality of driving switching elements applying the clock signals CKV1, CKV2, CKVB1, CKVB2 and the first panel gate off voltage VSSP1 to the gate lines GL. For example, the gate driver 600 may include first and second driving switching elements of which drain electrodes are connected to each other. Inverted input signals are applied to gate electrodes of the first and second driving switching elements. Thus, when the first driving switching element is turned on, the second driving switching element may be turned off. In contrast, when the first driving switching element is turned off, the second driving switching element may be turned on.

The gate driver 600 may be directly integrated on the display panel 100 in an amorphous silicon gate (ASG) type configuration.

The data driver 700 includes a data driving chip 710 and a flexible printed circuit board 720. The data driving chip 710 generates the grayscale data voltage, and outputs the grayscale data voltage to the data lines DL of the display panel 100. A first end portion of the flexible printed circuit board 720 is connected to the display panel 100, and a second end portion of the flexible printed circuit board 720 opposite to the first end portion is connected to the printed circuit board 800. The flexible printed circuit board 720 electrically connects the display panel 100 and the printed circuit board 800.

In the present exemplary embodiment, even though the data driving chip 710 is mounted on the flexible printed circuit board 720, the data driving chip 710 may be mounted on the display panel 100 or may be integrated on the display panel 100.

The data driver 700 receives grayscale data and a data control signal from the timing controller (not shown). For example, the data control signal may include a horizontal start signal, a load signal, an inverting signal and a data clock signal. The data driver 700 converts the grayscale data to an analog grayscale data voltage using a gamma reference voltage, and outputs the grayscale data voltage to the data lines DL.

Figure 2:
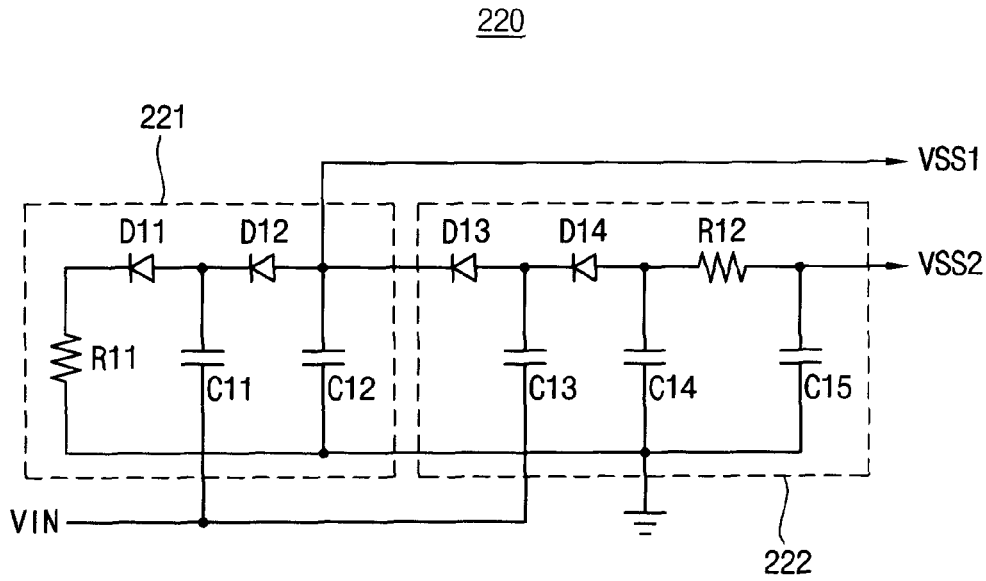
FIG. 2 is a circuit diagram illustrating the second voltage generating part of FIG. 1.

FIG. 2 is a circuit diagram illustrating the second voltage generating part 220 of FIG. 1.

Referring to FIG. 2, the second voltage generating part 220 includes a first gate off voltage generating part 221 and a second gate off voltage generating part 222. The second voltage generating part 220 receives an input voltage VIN.

The first gate off voltage generating part 221 generates the first gate off voltage VSS1 using the input voltage VIN. The second gate off voltage generating part 222 is connected to the first gate off voltage generating part 221, and generates the second gate off voltage VSS2 using the input voltage VIN.

The second voltage generating part 220 may include a charge pump circuit. The input voltage VIN may be a pulse width modulation signal.

The first gate off voltage generator 221 includes a first diode D11, a second diode D12, a first capacitor C11 and a second capacitor C12. The first gate off voltage generator 221 may further include a first resistor R11. An anode, which is a positive (+) electrode, of the first diode D11 is connected to a first terminal of the first capacitor C11, and a cathode, which is a negative (−) electrode, of the first diode D11 is connected to a first end of the first resistor R11. The input voltage VIN is applied to a second terminal of the first capacitor C11. A second end of the first resistor R11 is connected to ground. An anode of the second diode D12 is connected to a first terminal of the second capacitor C12, and a cathode of the second diode D12 is connected to the anode of the first diode D11. A second terminal of the second capacitor C12 is connected to ground. The first gate off voltage VSS1 is outputted at the anode of the second diode D12.

The second gate off voltage generator 222 includes a third diode D13, a fourth diode D14, a third capacitor C13 and a fourth capacitor C14. The second gate off voltage generator 222 may further include a second resistor R12 and a fifth capacitor C15. An anode of the third diode D13 is connected to a first terminal of the third capacitor C13, and a cathode of the third diode D13 is connected to the anode of the second diode D12 of the first gate off voltage generator 221. The input voltage VIN is applied to a second terminal of the third capacitor C13. An anode of the fourth diode D14 is connected to a first terminal of the fourth capacitor C14, and a cathode of the fourth diode D14 is connected to the anode of the third diode D13. A second terminal of the fourth capacitor C14 is connected to ground. A first end of the second resistor is connected to the anode of the fourth diode D14, and a second end of the second resistor is connected to a first terminal of the fifth capacitor C15. A second terminal of the fifth capacitor C15 is connected to ground. The second gate off voltage VSS2 is outputted at the second end of the second resistor R12. The second resistor R12 is a drop resistor to drop an absolute value of a voltage generated at the anode of the fourth diode D14. By adjusting the second resistor R12, the level of the second gate off voltage VSS2 may be adjusted properly. The fifth capacitor stabilizes the level of the second gate off voltage VSS2.

Figure 3:
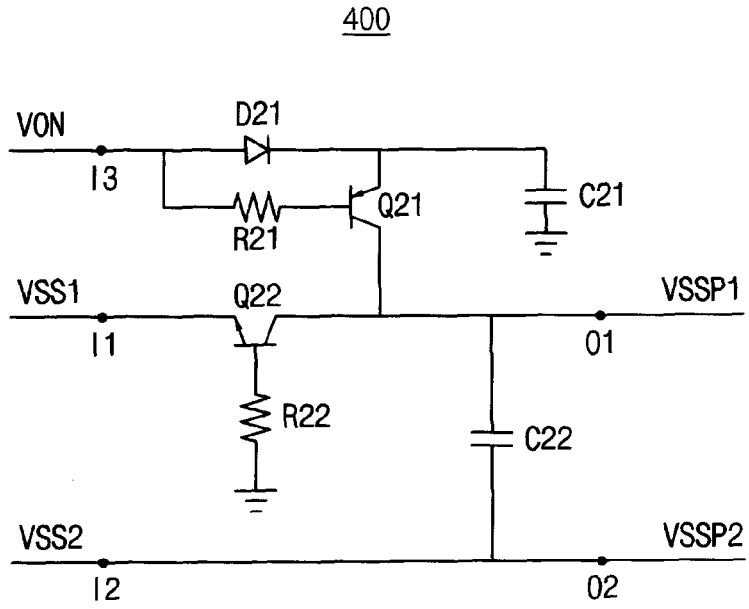
FIG. 3 is a circuit diagram illustrating the discharging part of FIG. 1.

FIG. 3 is a circuit diagram illustrating the discharging part 400 of FIG. 1.

Referring to FIGS. 1 and 3, the discharging part 400 includes a first input terminal I1 to which the first gate off voltage VSS1 is applied, a second input terminal I2 to which the second gate off voltage VSS2 is applied, a third input terminal I3 to which the gate on voltage VON is applied, a first output terminal O1 outputting the first panel gate off voltage VSSP1 and a second output terminal O2 outputting the second panel gate off voltage VSSP2.

The discharging part 400 includes a first switching element Q21, a first diode D21, a first resistor R21 and a first capacitor C21. The first switching element Q21 may be a PNP type bipolar junction transistor (BJT).

An emitter of the first switching element Q21 is connected to a cathode of the first diode D21, a base of the first switching element Q21 is connected to a first end of the first resistor R21, and a collector of the first switching element Q21 is connected to the first output terminal O1. An anode of the first diode D21 is connected to the third input terminal I3, and a second end of the first resistor R21 is connected to the third input terminal I3. A first terminal of the first capacitor C21 is connected to the emitter of the first switching element Q21, and a second terminal of the first capacitor C21 is connected to ground.

When the display apparatus is turned on, the gate on voltage has a relatively high positive value. Accordingly, the first switching element Q21 is turned off so that the third input terminal I3 is disconnected from the first output terminal O1, and the gate on voltage VON is charged in the first capacitor C21. The first switching element Q21 is turned off so that the first gate off voltage VSS1 is applied to the first output terminal O1. The discharging part 400 generates the first panel gate off voltage VSSP1 substantially the same as the first gate off voltage VSS1.

In contrast, when the display is turned off, the gate on voltage decreases. Accordingly, the first switching element Q21 is turned on so that the gate on voltage VON charged in the first capacitor C21 is applied to the first output terminal O1. The discharging part 400 generates the first panel gate off voltage VSSP1 substantially the same as the gate on voltage VON.

Therefore, the discharging part 400 outputs the first panel gate off voltage VSSP1 having a higher level when the display apparatus is turned off as compared to the first panel gate off voltage VSSP1 when the display apparatus is turned on. When the display apparatus is turned off, the gate on voltage VON may be gradually decreased from the relatively high positive value to ground so that the first panel gate off voltage VSSP1 may have a positive value.

In the present exemplary embodiment, even though the collector of the first switching element Q21 is connected to the first output terminal O1, and the gate on voltage VON is applied to the first output terminal O1, the circuit is not limited to the present exemplary embodiment. The collector of the first switching element Q21 may be connected to the second output terminal O2, and the gate on voltage VON may be applied to the second output terminal O2. Alternatively, the collector of the first switching element Q21 may be connected to both of the first and second output terminals O1, O2, and the gate on voltage VON may be selectively applied to one of the first and second output terminals O1, O2 by a selecting resistor.

The discharging part 400 further includes a second capacitor C22 connected between the first and, second output terminals O1, O2. The second output terminal O2 is directly connected to the second input terminal I2 so that the second gate off voltage VSS2 is directly applied to the second output terminal O2 when the display apparatus is turned on. Accordingly, the discharging part 400 may generate the second panel gate off voltage VSSP2 substantially the same as the second gate off voltage VSS2.

When the display apparatus is turned off, the first panel gate off voltage VSSP1 is boosted to the high level as explained above. In addition, the second panel gate off voltage VSSP2 is also boosted by the second capacitor C22. Accordingly, the discharging part 400 may generate the second panel gate off voltage VSSP2 greater than the second gate off voltage VSS2. The second panel gate off voltage VSSP2 is boosted to approach the level of the first panel gate off voltage VSSP1.

The discharging part 400 may further include a second switching element Q22 connected between the first input terminal I1 and the first output terminal O1. The second switching element Q22 may be a NPN type BJT.

An emitter of the second switching element Q22 is connected to the first input terminal I1, a base of the second switching element Q22 is connected to ground, and a collector of the second switching element Q22 is connected to the first output terminal O1.

When the display apparatus is turned on, the first gate off voltage VSS1 have a negative value. Accordingly the second switching element Q22 is turned on so that the first gate off voltage VSS1 is applied to the first output terminal O1.

When the display apparatus is turned off, the second switching element Q22 is turned off so that the first input terminal I1 is disconnected from the first output terminal O1. As explained above, when the display apparatus is turned off, the gate on voltage VON is applied to the first output terminal O1. With the second switching element Q22 being turned off, the gate on voltage VON is not applied to the second voltage generating part 220 or other external elements through the first input terminal I1 so that the gate on voltage VON may be fully applied to the display panel side 100.

Figure 4:
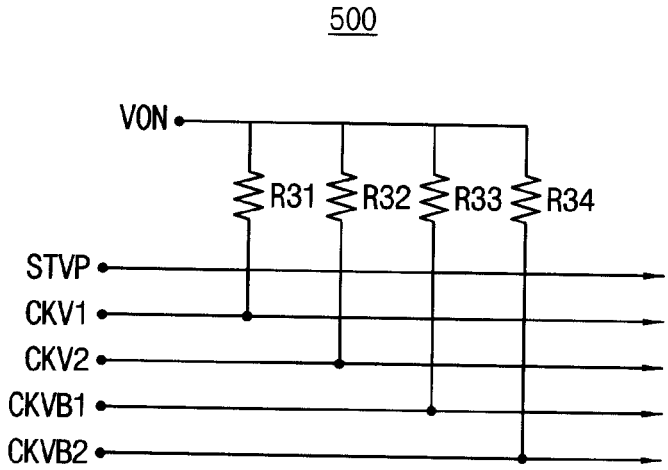
FIG. 4 is a circuit diagram illustrating the pull-up part of FIG. 1.

FIG. 4 is a circuit diagram illustrating the pull-up part 500 of FIG. 1.

Referring to FIGS. 1 and 4, the pull-up part 500 includes a plurality of pull-up resistors R31, R32, R33, R34.

The pull-up part 500 may receive the gate on voltage VON from the first voltage generating part 210. The gate on voltage VON is applied to first ends of the pull-up resistors R31, R32, R33, R34, and second ends of the pull-up resistors R31, R32, R33, R34 are connected to the output terminals of the signal generator 300 from which the clock signals CKV1, CKV2, CKVB1, CKVB2 are outputted. The number of pull-up resistors may correspond to the number of clock signals.

The pull-up resistors R31, R32, R33, R34 may have relatively high resistances. For example, the pull-up resistors R31, R32, R33, R34 may be respectively 1MΩ.

When the display apparatus is turned on, resistances of the pull-up resistors R31, R32, R33, R34 are very high, so that the pull-up resistors R31, R32, R33, R34 does not influence to the clock signals CKV1, CKV2, CKVB1, CKVB2.

When the display apparatus is turned off, circuits in the signal generator 300 may be converged to infinite resistance so that the resistances of the pull-up resistors R31, R32, R33, R34 are relatively low. Thus, the clock signals CKV1, CKV2, CKVB1, CKVB2 may be pulled up using the gate on voltage VON.

In the present exemplary embodiment, even though the clock signals CKV1, CKV2, CKVB1, CKVB2 are be pulled up using the gate on voltage VON, the circuit configuration is not limited to the present exemplary embodiment. The clock signals CKV1, CKV2, CKVB1, CKVB2 may be pulled up using other voltages.

Figure 5:
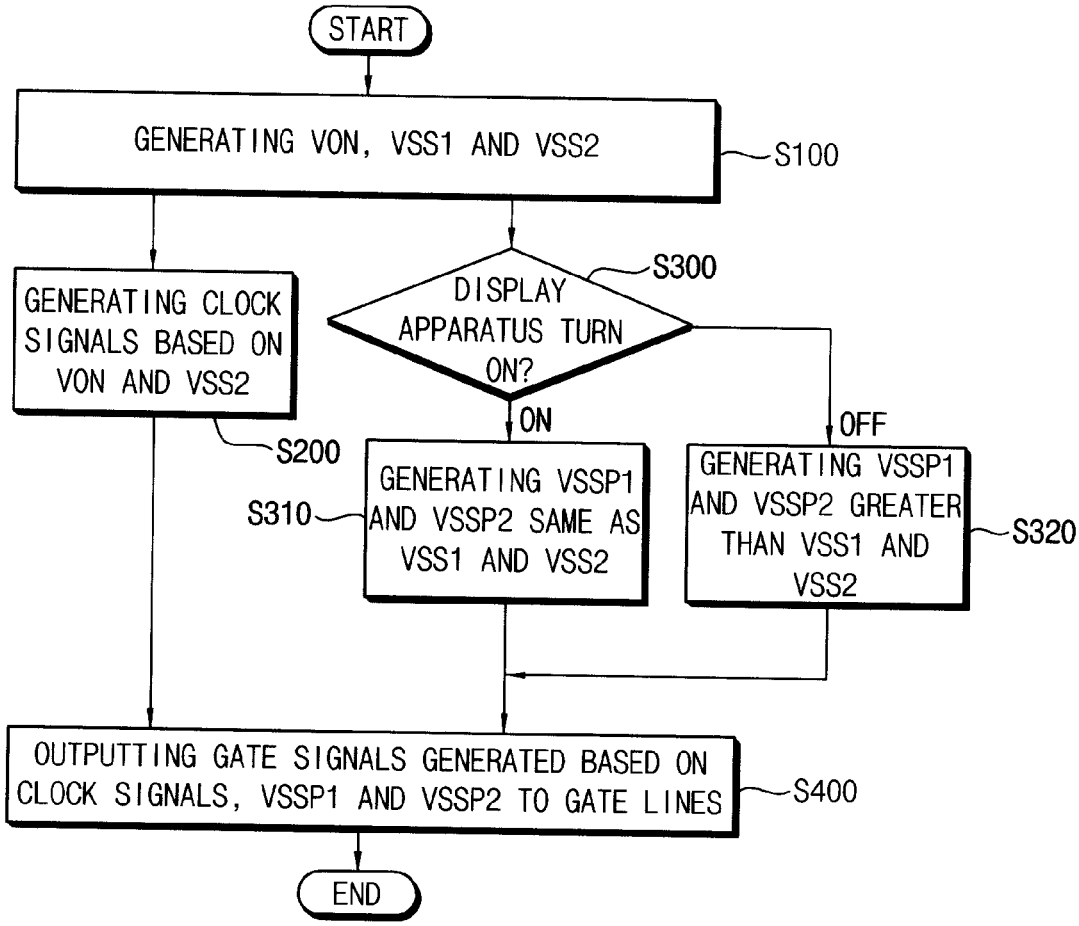
FIG. 5 is a flowchart illustrating a method of driving the display panel of FIG. 1.

FIG. 5 is a flowchart illustrating a method of driving the display panel 100 of FIG. 1.

Referring to FIGS. 1 and 5, the voltage generator 200 generates the gate on voltage VON, the first gate off voltage VSS1 and the second gate off voltage VSS2 (step S100).

The signal generator 300 generates the clock signals CKV1, CKV2, CKVB1, CKVB2 based upon the gate on voltage VON and the second gate off voltage VSS2 (step S200).

The discharging part 400 differently operates according to whether the display apparatus is turned on or off (step S300).

When the display apparatus is turned on, the discharging part 400 generates the first panel gate off voltage VSSP1 substantially the same as the first gate off voltage VSS1 and the second panel gate off voltage VSSP2 substantially the same as the second gate off voltage VSS2 (step S310).

When the display apparatus is turned off, the discharging part 400 generates the first panel gate off voltage VSSP1 greater than the first gate off voltage VSS1 and the second panel gate off voltage VSSP2 greater than the second gate off voltage VSS2 (step S320).

The gate driver 600 generates the gate signal based upon the clock signals CKV1, CKV2, CKVB1, CKVB2 and the first and second panel gate off voltages VSSP1, VSSP2, and outputs the gate signal to the gate line GL of the display panel (step S400).

Figure 6:
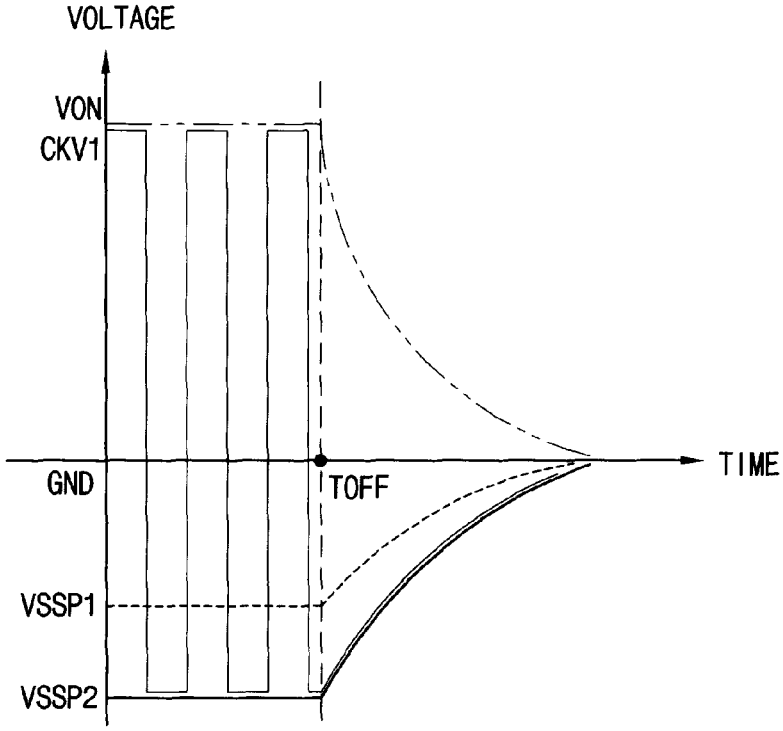
FIG. 6 is a waveform diagram illustrating driving signals of a display panel according to a comparative exemplary embodiment of the present invention.

FIG. 6 is a waveform diagram illustrating driving signals of a display panel according to a comparative exemplary embodiment of the present invention.

Referring to FIGS. 1 and 6, a display apparatus according to the comparative exemplary embodiment includes the display panel 100, the voltage generator 200, the signal generator 300, the gate driver 600, the data driver 700 and the printed circuit board 800, and does not include the discharging part 400 and the pull-up part 500. When the discharging part 400 is removed, the first panel gate off voltage VSSP1 is substantially the same as the first gate off voltage VSS1, and the second panel gate off voltage VSSP2 is substantially the same as the second gate off voltage VSS2.

The gate on voltage VON has a positive value, and the first and second gate off voltages VSS1, VSS2 respectively have negative values. The second gate off voltage VSS2 may be smaller than the first gate off voltage VSS1. The gate on voltage VON and the first and second gate off voltages VSS1, VSS2 are respectively DC voltages having uniform levels.

The first clock signal CKV1 increases and decreases between the gate on voltage VON and the second gate off voltage VSS2 in a predetermined cycle.

The display apparatus is turned off at a turn-off moment TOFF.

When the display apparatus is turned off, current flows to the display apparatus stop, and all of the voltages applied to the display apparatus are gradually converged to the ground level GND. For example, the gate on voltage VON and the first and second gate off voltages VSS1, VSS2 are converged from the uniform levels to the ground level GND. In addition, the first clock signal CKV1 swinging in the predetermined cycle is converged to the ground level GND.

The gate driver 600 generates the gate signal based upon the gate on voltage VON and the first and second gate off voltages VSS1, VSS2, and outputs the gate signal to the gate line GL of the display panel 100. The gate signal has a negative value or a value around the ground level GND so that turn-on of the switching element TFT of the display panel 100 may be not guaranteed. Thus, the grayscale data voltage charged to the pixel electrode (not shown) of the display panel 100 may be not quickly discharged.

Figure 7:
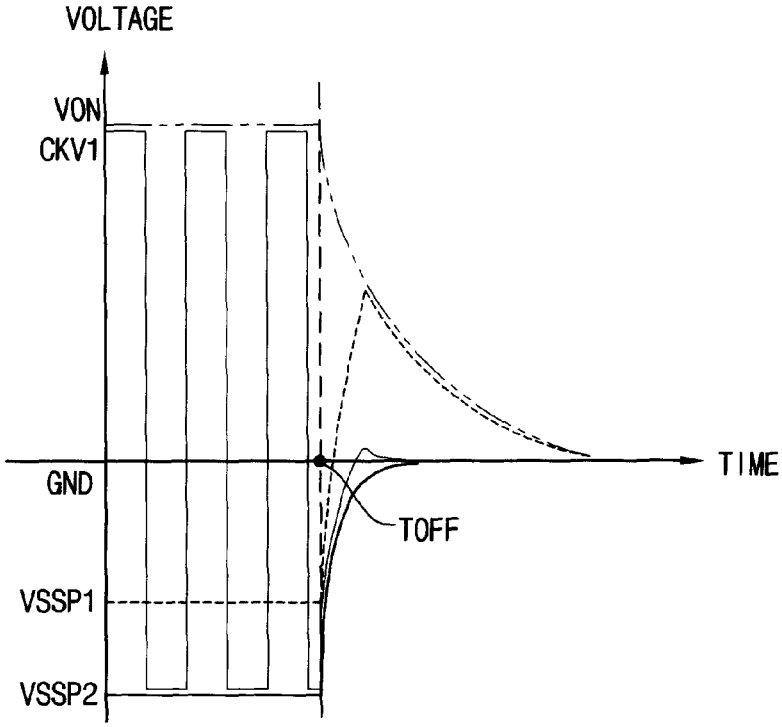
FIG. 7 is a waveform diagram illustrating driving signals of the display panel of FIG. 1.

FIG. 7 is waveform diagram illustrating driving signals of the display panel 100 of FIG. 1.

Referring to FIGS. 1, 3, 4, 6 and 7, when the display apparatus is turned on, the discharging part 400 generates the first panel gate off voltage VSSP1 substantially the same as the first gate off voltage VSS1 and the second panel gate off voltage VSSP2 substantially the same as the second gate off voltage VSS2.

Thus, when the display apparatus is turned on, the waveforms of the driving signals of the display panel 100 may be substantially the same as the waveforms in FIG. 6.

When the display apparatus is turned off at a turn-off moment TOFF, current flows to the display apparatus stop, and the gate on voltage VON is gradually converged to the ground level GND.

When the display apparatus is turned off, the first switching element Q21 is turned on so that the gate on voltage VON charged in the first capacitor C21 is applied to the first output terminal O1. In addition, the second switching element Q22 is turned off so that the first input terminal I1 is disconnected from the first output terminal O1. By the second switching element Q22, the gate on voltage VON is not applied to the second voltage generating part 220 or other external elements through the first input terminal I1. Thus, the discharging part 400 generates the first gate off voltage VSSP1 substantially the same as the gate on voltage VON.

When the first panel gate off voltage VSSP1 is boosted to a relatively high level, the second panel gate off voltage VSSP2 is also boosted by the second capacitor C22. The second panel gate off voltage VSSP2 is boosted to approach to the level of the first panel gate off voltage VSSP1.

When the display apparatus is turned off, the clock signals CKV1, CKV2, CKVB1, CKVB2 may be pulled up using the gate on voltage VON by the resistances of the pull-up resistors R31, R32, R33, R34 connected to the output terminals of the signal generator 300.

As shown in FIG. 7, the first panel gate off voltage VSSP1 is boosted from the level of the first gate off voltage VSS1 to the gate on voltage VON in a moment. The second panel gate off voltage VSSP2 is boosted from the level of the second gate off voltage VSS2 to approach to the first panel gate off voltage VSSP1. In addition, the clock signals CKV1, CKV2, CKVB1, CKVB2 are boosted to approach to the gate on voltage VON.

According to the present exemplary embodiment explained above, when the display apparatus is turned off, the first and second panel gate off voltages VSSP1, VSSP2 and the clock signals CKV1, CKV2, CKVB1, CKVB2 is boosted a level greater than the ground level GND or is quickly converged to the ground level GND. By the gate signal generated based upon the first and second panel gate off voltages VSSP1, VSSP2 and the clock signals CKV1, CKV2, CKVB1, CKVB2, the switching element TFT is easily turned on, so that the grayscale data voltage charged to the pixel electrode (not shown) of the display panel 100 may be quickly discharged through the data line DL. Thus, when the display apparatus is turned off, an image on the display panel may quickly disappear.

Figure 8:
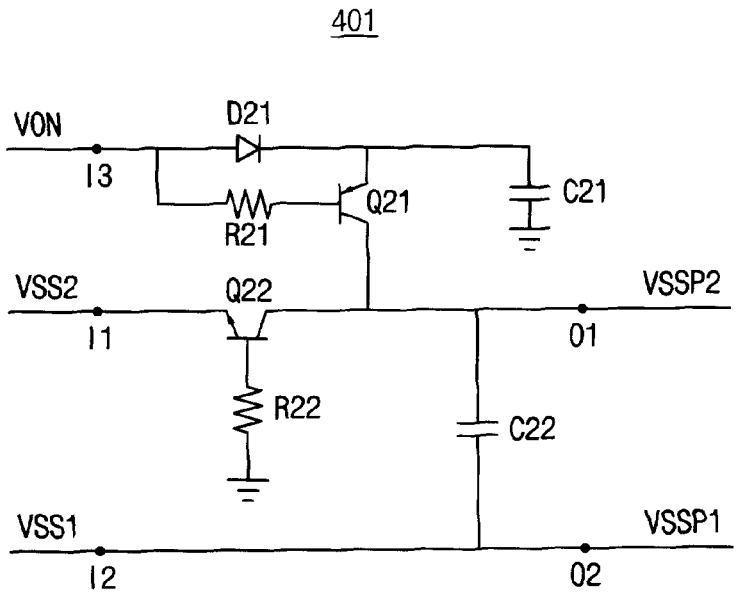
FIG. 8 is a circuit diagram illustrating a discharging part according to an exemplary embodiment of the present invention.

FIG. 8 is a circuit diagram illustrating a discharging part according to an exemplary embodiment of the present invention.

A display apparatus and a method of driving a display panel according to the present exemplary embodiment are substantially the same as the display apparatus and the method of driving the display panel 100 according to the previous exemplary embodiment of FIGS. 1 to 5 except for a discharging part. Thus, the same reference numerals will be used to refer to the same or like parts as those described in the previous exemplary embodiment of FIGS. 1 to 5 and any repetitive explanation concerning the above elements will be omitted.

Referring to FIGS. 1 and 8, the discharging part 401 includes a first input terminal I1 to which the second gate off voltage VSS2 is applied, a second input terminal I2 to which the first gate off voltage VSS1 is applied, a third input terminal I3 to which the gate on voltage VON is applied, a first output terminal O1 outputting the second panel gate off voltage VSSP2 and a second output terminal O2 outputting the first panel gate off voltage VSSP1.

The discharging part 401 includes a first switching element Q21, a first diode D21, a first resistor R21 and a first capacitor C21. The first switching element Q21 may be a PNP type BJT.

An emitter of the first switching element Q21 is connected to a cathode of the first diode D21, a base of the first switching element Q21 is connected to a first end of the first resistor R21, and a collector of the first switching element Q21 is connected to the first output terminal O1. An anode of the first diode D21 is connected to the third input terminal I3, and a second end of the first resistor R21 is connected to the third input terminal I3. A first terminal of the first capacitor C21 is connected to the emitter of the first switching element Q21, and a second terminal of the first capacitor C21 is connected to ground.

When the display apparatus is turned on, the gate on voltage has a relatively high positive value. Accordingly, the first switching element Q21 is turned off so that the third input terminal I3 is disconnected from the first output terminal O1, and the gate on voltage VON is charged in the first capacitor C21. The first switching element Q21 is turned off so that the second gate off voltage VSS2 is applied to the first output terminal O1. The discharging part 401 generates the second panel gate off voltage VSSP2 substantially the same as the second gate off voltage VSS2.

In contrast, when the display is turned off, the gate on voltage decreases. Accordingly, the first switching element Q21 is turned on so that the gate on voltage VON charged in the first capacitor C21 is applied to the first output terminal O1. The discharging part 401 generates the second panel gate off voltage VSSP2 substantially the same as the gate on voltage VON.

Therefore, the discharging part 401 outputs the second panel gate off voltage VSSP2 having higher level when the display apparatus is turned off as compared to the second panel gate off voltage VSSP2 when the display apparatus is turned on. When the display apparatus is turned off, the gate on voltage VON may be gradually decreased from the relatively high positive value to ground so that the second panel gate off voltage VSSP2 may have a positive value.

The discharging part 401 further includes a second capacitor C22 connected between the first and second output terminals O1, O2. The second output terminal O2 is directly connected to the second input terminal I2 so that the first gate off voltage VSS1 is directly applied to the second output terminal O2 when the display apparatus is turned on. Accordingly, the discharging part 401 may generate the first panel gate off voltage VSSP1 substantially the same as the first gate off voltage VSS1.

When the display apparatus is turned off, the second panel gate off voltage VSSP2 is boosted to the high level as explained above. In addition, the first panel gate off voltage VSSP1 is also boosted by the second capacitor C22. Accordingly, the discharging part 401 may generate the first panel gate off voltage VSSP1 greater than the first gate off voltage VSS1. The first panel gate off voltage VSSP1 is boosted to approach to the level of the second panel gate off voltage VSSP2.

The discharging part 401 may further include a second switching element Q22 connected between the first input terminal I1 and the first output terminal O1. The second switching element Q22 may be a NPN type BJT.

An emitter of the second switching element Q22 is connected to the first input terminal I1, a base of the second switching element Q22 is connected to ground, and a collector of the second switching element Q22 is connected to the first output terminal O1.

When the display apparatus is turned on, the second gate off voltage VSS2 have a negative value. Accordingly the second switching element Q22 is turned on so that the second gate off voltage VSS2 is applied to the first output terminal O1.

When the display apparatus is turned off, the second switching element Q22 is turned off so that the first input terminal I1 is disconnected from the first output terminal O1. As explained above, when the display apparatus is turned off, the gate on voltage VON is applied to the first output terminal O1. By the second switching element Q22, the gate on voltage VON is not applied to the second voltage generating part 220 or other external elements through the first input terminal I1 so that the gate on voltage VON may be fully applied to the display panel side 100.

Figure 9:
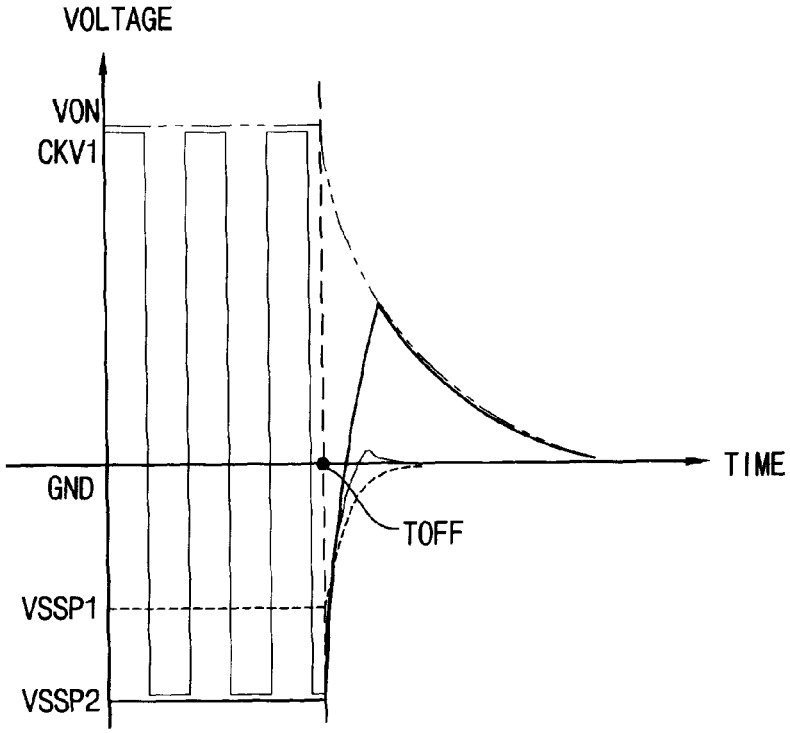
FIG. 9 is waveform diagram illustrating driving signals of the display panel including the discharging part of FIG. 8.

FIG. 9 is waveform diagram illustrating driving signals of the display panel including the discharging part 401 of FIG. 8.

Referring to FIGS. 1, 4, 6, 8 and 9, when the display apparatus is turned on, the discharging part 401 generates the first panel gate off voltage VSSP1 substantially the same as the first gate off voltage VSS1 and the second panel gate off voltage VSSP2 substantially the same as the second gate off voltage VSS2.

Thus, when the display apparatus is turned on, the waveforms of the driving signals of the display panel 100 may be substantially the same as the waveforms in FIG. 6.

When the display apparatus is turned off at a turn-off moment TOFF, current flows to the display apparatus stop, and the gate on voltage VON is gradually converged to the ground level GND.

When the display apparatus is turned off, the first switching element Q21 is turned on so that the gate on voltage VON charged in the first capacitor C21 is applied to the first output terminal O1. In addition, the second switching element Q22 is turned off so that the first input terminal I1 is disconnected from the first output terminal O1. By the second switching element Q22, the gate on voltage VON is not applied to the second voltage generating part 220 or other external elements through the first input terminal I1. Thus, the discharging part 401 generates the second gate off voltage VSSP2 substantially the same as the gate on voltage VON.

When the second panel gate off voltage VSSP2 is boosted to a relatively high level, the first panel gate off voltage VSSP1 is also boosted by the second capacitor C22. The first panel gate off voltage VSSP1 is boosted to approach to the level of the second panel gate off voltage VSSP2.

When the display apparatus is turned off, the clock signals CKV1, CKV2, CKVB1, CKVB2 may be pulled up using the gate on voltage VON by the resistances of the pull-up resistors R31, R32, R33, R34 connected to the output terminals of the signal generator 300.

As shown in FIG. 9, the second panel gate off voltage VSSP2 is boosted from the level of the second gate off voltage VSS2 to the gate on voltage VON in a moment. The first panel gate off voltage VSSP1 is boosted from the level of the first gate off voltage VSS1 to approach to the second panel gate off voltage VSSP2. In addition, the clock signals CKV1, CKV2, CKVB1, CKVB2 are boosted to approach to the gate on voltage VON.

According to the present exemplary embodiment explained above, when the display apparatus is turned off, the first and second panel gate off voltages VSSP1, VSSP2 and the clock signals CKV1, CKV2, CKVB1, CKVB2 is boosted a level greater than the ground level GND or is quickly converged to the ground level GND. By the gate signal generated based upon the first and second panel gate off voltages VSSP1, VSSP2 and the clock signals CKV1, CKV2, CKVB1, CKVB2, the switching element TFT is easily turned on, so that the grayscale data voltage charged to the pixel electrode (not shown) of the display panel 100 may be quickly discharged through the data line DL. Thus, when the display apparatus is turned off, an image on the display panel may quickly disappear.

As explained above, the first and second panel gate off voltages VSSP1, VSSP2 and the clock signals CKV1, CKV2, CKVB1, CKVB2 are adjusted so that an image on the display panel may be quickly disappear when the display apparatus is turned off.

Although a few exemplary embodiments of the present invention have been described, those skilled in the art will readily appreciate that many modifications are possible in the exemplary embodiments without materially departing from the novel teachings and advantages of the present invention. Therefore, it is to be understood that the foregoing is not to be construed as limited to the specific exemplary embodiments disclosed, and that the disclosed exemplary embodiments, modifications thereto, as well as other exemplary embodiments, are intended to be included within the scope of the appended claims.

What is claimed is:

1. A method of driving a display panel, the method comprising:

generating a gate on voltage, a first gate off voltage and a second gate off voltage;

generating a clock signal based upon the gate on voltage and the second gate off voltage;

in a first operating mode generating a first panel gate off voltage substantially the same as the first gate off voltage and a second panel gate off voltage substantially the same as the second gate off voltage, in a second operating mode generating a first panel gate off voltage greater than the first gate off voltage and a second panel gate off voltage greater than the second gate off voltage; and outputting a gate signal generated based upon the clock signal and the first and second panel gate off voltages to a gate line of the display panel.

2. The method of claim 1, wherein:

the first operating mode is performed when a display apparatus is turned on, and the second operating mode is performed when the display apparatus is turned off.

3. The method of claim 2, wherein the first panel gate off voltage is generated based upon the gate on voltage in the second operating mode.

4. The method of claim 3, wherein generating the second panel gate off voltage includes boosting the second panel gate off voltage based upon the first panel gate off voltage in the second operating mode.

5. The method of claim 3, wherein generating the second panel gate off voltage further includes disconnecting a first input terminal to which the first gate off voltage is applied from a first output terminal outputting the first panel gate off voltage in the second operating mode.

6. The method of claim 2, further comprising pulling up the clock signal in the second operating mode.

7. The method of claim 1, wherein:

the gate on voltage has a positive value, the first and second gate off voltages have negative values, and the second gate off voltage is more negative than the first gate off voltage.

8. A display apparatus comprising:

a display panel that displays an image;

a voltage generator that generates a gate on voltage, a first gate off voltage and a second gate off voltage;

a signal generator that generates a clock signal based upon the gate on voltage and the second gate off voltage;

a discharging part that generates a first panel gate off voltage substantially the same as the first gate off voltage and a second panel gate off voltage substantially the same as the second gate off voltage in a first operating mode, and that generates a first panel gate off voltage greater than the first gate off voltage and a second panel gate off voltage greater than the second gate off voltage in a second operating mode; and a gate driver that generates a gate signal based upon the clock signal and the first and second panel gate off voltages, and that outputs the gate signal to a gate line of the display panel.

9. The display apparatus of claim 8, wherein the first operating mode is performed when the display apparatus is turned on, and the second operating mode is performed when the display apparatus is turned off.

10. The display apparatus of claim 9, wherein the discharging part includes:

a first input terminal to which the first gate off voltage is applied;

a second input terminal to which the second gate off voltage is applied;

a first output terminal that outputs the first panel gate off voltage; and a second output terminal that outputs the second panel gate off voltage.

11. The display apparatus of claim 10, wherein the discharging part generates the first panel gate off voltage based upon the gate on voltage in the second operating mode.

12. The display apparatus of claim 11, wherein the discharging part includes:

a first capacitor in which the gate on voltage is charged in the first operating mode; and a first switching element that transmits the gate on voltage charged in the first capacitor to the first output terminal in the second operating mode.

13. The display apparatus of claim 12, wherein the discharging part further includes a second capacitor connected between the first and second output terminals to boost the second panel gate off voltage.

14. The display apparatus of claim 12, wherein the discharging part further includes a second switching element that disconnects the first input terminal from the first output terminal in the second operating mode.

15. The display apparatus of claim 14, wherein the second switching element includes a NPN type bipolar junction transistor.

16. The display apparatus of claim 8, further comprising a pull-up part connected to an output terminal of the signal generator, and that pulls up the clock signal in the second operating mode.

17. The display apparatus of claim 16, wherein the pull-up part includes a pull-up resistor, the gate on voltage is applied to a first end of the pull-up resistor, and a second end of the pull-up resistor is connected to the output terminal of the signal generator.

18. The display apparatus of claim 8, wherein the voltage generator includes a first gate off voltage generating part that generates the first gate off voltage using an input voltage, and a second gate off voltage generating part connected to the first gate off voltage generating part, the second gate off voltage generating part generating the second gate off voltage, and the first and second gate off voltage generating parts respectively include a diode and a capacitor.

19. The display apparatus of claim 8, wherein:

the gate on voltage has a positive value, the first and second gate off voltages have negative values, and the second gate off voltage is more negative than the first gate off voltage.

20. The display apparatus of claim 8, wherein the gate driver is integrated on the display panel to have an amorphous silicon gate type.

21. A method for driving a display panel, comprising:

driving a gate line of a display panel during a turn-on period based upon a gate on voltage having a voltage value for turning on a switching element coupled to the gate line of the display panel;

discharging the gate line based upon a first gate off voltage and a second gate off voltage for discharging the gate line of the display panel, first gate off voltage and the second gate off voltage having voltage values for turning off the switching element; and using the second gate off voltage during a first time period from a turn-off moment of the switching element and using the first gate off voltage after the first time period from the turn-off moment of the switching element to maintain the switching element turned off, wherein the gate on voltage has a positive value and the first gate off voltage and the second gate off voltage have negative values, the second gate off voltage being more negative than the first gate off voltage.

* * * * *